US005496128A

United States Patent [19]

Odill

[11] Patent Number: 5,496,128

[45] Date of Patent: Mar. 5, 1996

[54] ADJUSTABLE FASTENING BAND FOR A MANHOLE CHIMNEY SEAL AND METHOD OF USING

[75] Inventor: Frank J. Odill, West Allis, Wis.

[73] Assignee: Cretex Companies, Inc., Elk River, Minn.

[21] Appl. No.: 370,077

[22] Filed: Jan. 9, 1995

[51] Int. Cl.[6] ..... E02D 29/14

[52] U.S. Cl. ..... 404/25; 404/26; 52/19; 52/20; 277/109

[58] Field of Search ..... 404/25, 26; 277/101, 277/138, 147; 52/20, 19; 285/109, 226, 236

[56] References Cited

U.S. PATENT DOCUMENTS

| | | | |
|---|---|---|---|
| 3,516,446 | 6/1970 | O'Hargen et al. . | |
| 4,469,467 | 9/1984 | Odill et al. | 404/25 |
| 4,621,941 | 11/1986 | Ditcher et al. | 404/26 |
| 4,737,220 | 4/1988 | Ditcher et al. | 156/218 |
| 4,903,970 | 2/1990 | Ditcher et al. | 277/9.5 |
| 5,029,907 | 7/1991 | Gundy | 285/158 |
| 5,054,794 | 10/1991 | Westhoff et al. | 277/101 |
| 5,150,927 | 9/1992 | Skinner | 285/189 |
| 5,209,601 | 5/1993 | Odill et al. | 404/26 |
| 5,431,459 | 7/1995 | Gundy | 285/237 |

FOREIGN PATENT DOCUMENTS 0021454 1/1981 European Pat. Off. .

*Primary Examiner*—Ramon S. Britts
*Assistant Examiner*—Pamela A. O'Connor
*Attorney, Agent, or Firm*—Quarles & Brady

[57] ABSTRACT

An internal fastening band for an internal manhold chimney seal is disclosed, as well as a means for expanding the band and a means for removing the band. One end of the band is narrower than the other end so that when overlapped the ends of the band nest into one another to form a continuous expansion band. The first end portion has a plurality of apertures longitudinally spaced along the fastening band, and a plurality of slots spaced between the apertures and an end of the fastening band. The second end portion also has a aperture along a tab for engaging one of the slots to connect the first end portion to the second end portion with the particular slot being selected to adjust the continuous circular fastening band to a desired diameter. A tool is described for engaging an aperture in each end portion to increase the diameter of the circular expansion band and force the resilient sleeve against the inside surface of the manhole. An attachment for this tool to provide for the removal of this band is also disclosed.

30 Claims, 3 Drawing Sheets

ADJUSTABLE FASTENING BAND FOR A MANHOLE CHIMNEY SEAL AND METHOD OF USING

BACKGROUND OF THE INVENTION

The present invention relates to manholes and more particularly to an improved fastening band for compressing the sealing sections of an internal manhole chimney seal against the manhole casting and the surface of the manhole assembly below the corbel joint to be sealed.

A manhole typically includes a main chamber or barrel portion to which the sewer pipes are connected. This section is topped with an inward and upward sloping cone section in which the diameter is reduced to that needed to fit the manhole casting. The manhole casting, which receives the manhole cover, may either sit directly on the manhole cone or there may be intermediate adjusting rings. This adjustment portion, commonly referred to as the "chimney", may be constructed of precast grade rings, or courses of brick or of block, as needed to vary the elevation of the manhole casting.

When the manhole is assembled, the spaces between the different components are sealed with mortar or other material to prevent water infiltration. Nevertheless, thermal movement of the frame due to seasonal temperature changes and vibration from vehicles passing over the manhole cause cracks to form between the frame and chimney and in the chimney through which surface water is able to enter the manhole. Such ground water infiltration often is undesirable.

Various types of internal seals have been devised to prevent such water infiltration. Typically a resilient sleeve is inserted into the manhole chimney and held against the internal surface of the manhole by a fastening band or other apparatus. The previous fastening mechanisms have certain limitations that make their use difficult or time consuming. For example, U.S. Pat. No. 4,305,679 issued to Arvind O. Modi discloses a brace arrangement having an internal circular bracing member and a four part segmented ring which presses against the sealing sections on each end of the resilient sleeve. With the Modi apparatus, four elongated bolts interconnect the bracing member and the outer ring segments and each bolt must be tightened with a nut to force each of the segments against the sleeve. Because this installed seal assembly blocks entry into the manhole, it must be removed to enter and then reinstalled after departure from the manhole.

U.S. Pat. No. 4,469,467 issued to Frank J. Odill et al. teaches an expandable fastening band which does not restrict or prevent ingress or egress into and out of the manhole assembly. The fastening bands disclosed in this patent have lugs attached to each overlapped end which are interconnected by a curved bolt. Nuts on a threaded rod are then rotated in partial turns by a wrench to expand the band to compress the seal against the manhole surface. Because of the closeness of the bolt to the band, expansion requires repeated repositioning of the wrench since only approximately one-third of a turn can be achieved with each positioning of the wrench. Another problem is that the bolt mechanism protrudes into the manhole opening. As a result, a person entering or exiting the manhole could be scratched or cut by the sharp surfaces of the bolt mechanism or parts of the person's clothing could catch on that mechanism.

U.S. Pat. No. 4,557,625 issued to Richard P. Jahnke et al. disclose a circular hoop having circumferentially moveable end portions with a inward radially extending bracket mounted on each end at circumferentially spaced locations. These brackets are pulled toward each other to increase the circumference of the hoop and compress the seal against the manhole surface, by tightening nuts threaded onto the outer end of two bolts connecting the brackets together. The brackets protrude into the manhole opening and pose a significant hazard when a person enters or exits the manhole. Another problem is the limited diameter range that this design provides.

All of the aforementioned fastening bands either limit manhole ingress and egress or present hazards to such movement. Some of them lack an adequate diameter adjustment range and all require a plurality of steps to arrange and position each of the elements of the expansion apparatus and to expand the band in position in order to produce an acceptable product. In addition, all of the aforementioned designs have limitations which increase the time of installation. As a consequence, it is desirable to provide a one piece fastening band with a significant continual adjustable diameter range, which does not have components which could injure or impede a person entering or leaving the manhole, and is simple and quick to install.

SUMMARY OF THE INVENTION

A general object of the present invention is to provide an inexpensive adjustable band for compressing an internal manhole chimney seal against the chimney or cone and the casting of the manhole.

Another object of the present invention is to provide such a fastening band which can be adjusted to accommodate size variations in the manhole chimney, cone and casting, without the necessity of additional locking means.

A further object of the present invention is to provide a method by which the fastening band can be released in order to remove the band without damaging it, if such removal is required.

A manhole chimney seal includes a resilient sleeve which is compressed against the interior surface of the manhole chimney or cone and frame by a pair of fastening bands to prevent water infiltration. The resilient sleeve accommodates vertical and horizontal movement of the manhole casting, due to frost action and shifting ground conditions, without disturbing the water tightness of the seal 24.

Each fastening band has first and second end portions which overlap and which when connected together form a continuous circular fastening band. The first end portion has at least one aperture, and a plurality of slots spaced longitudinally along the fastening band between the aperture and an end of the fastening band. The second end portion has a aperture. The second end portion also has a tab for engaging one of the slots to connect the first end portion to the second end portion with the particular slot being selected to adjust the continuous circular fastening band to a desired diameter.

Preferably a tool is provided for adjusting the diameter of the continuous circular fastening band to thereby force a sealing section of the resilient sleeve against the inside surface of the manhole. The tool comprises first and second legs pivotally attached to one another and having ends for engaging an aperture in each end portion of the fastening band. A mechanism attached to the first and second legs produces pivotal movement therebetween which movement slides the two fastening band end portions relative to each other. That sliding action increases the diameter of the fastening band and compresses the resilient sleeve against the interior manhole surface.

A band removal fixture is also disclosed which, when used in conjunction with the expansion tool, provides for the non-destructive removal of the fastening band. The band removal fixture has a body with a pair of wedge shaped claws extending therefrom. When forced against the inside overlapped end of the fastening band, the removal fixture forces the tab out of the slot to allow for the band's removal.

DETAILED DESCRIPTION OF THE INVENTION

Figure 1:
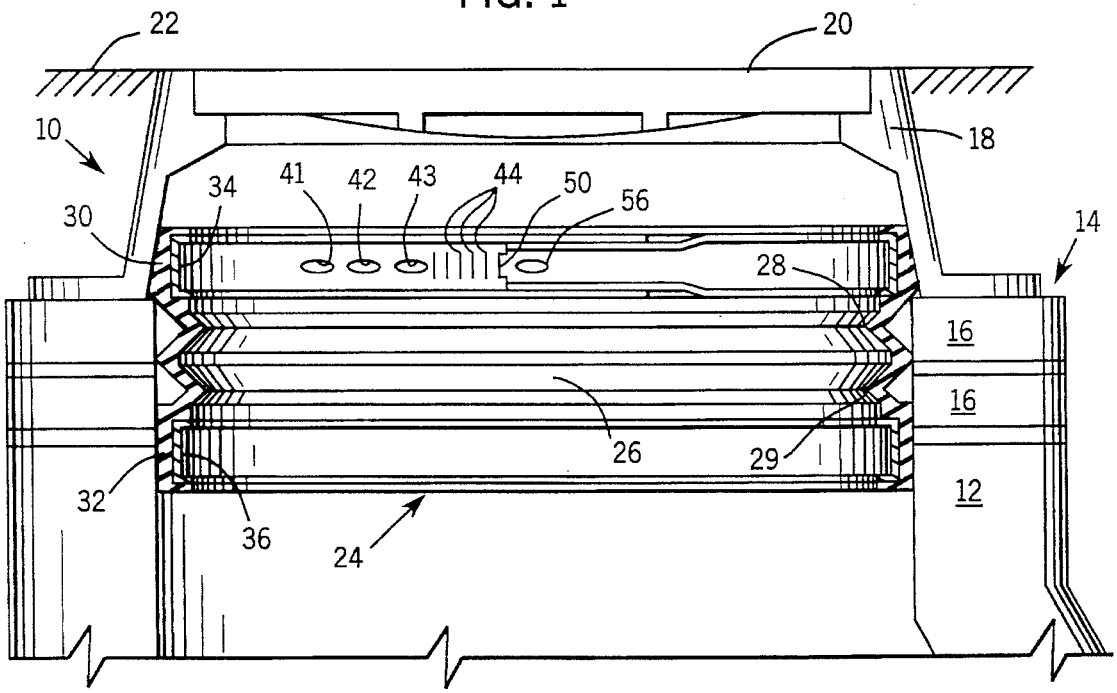
FIG. 1 is a cross sectional view of the upper section of a manhole having an internal chimney seal with fastening bands of the instant invention locking both sealing sections to the surfaces of the manhole casting and the manhole assembly.

With initial reference to FIG. 1, a manhole 10 comprises a conical riser 12 which is typically formed of precast concrete. Above the riser 12 are two precast concrete adjusting rings 16 on top of which is a metal manhole casting 18. The number of adjusting rings 16 vary so that the chimney 14 has a height that places the upper end of the casting 18 level with the ground surface 22. A manhole cover 20 is shown located in the upper opening of the manhole casting 18.

A chimney seal 24 is attached inside the manhole 10 to provide a watertight barrier along the seams between the manhole casting 18 and the manhole cone 12. The seal 24 consists of an extruded resilient sleeve 26 which can be constructed of rubber or a rubber-type material. The resilient sleeve 26 has two center pleats 28 and 29 located in between cylindrical sealing sections 30 and 32 at opposite ends of the sleeve. Additional pleats or a flat section may be placed between the two pleats 28 and 29 to provide a seal that is able to span taller manhole chimneys. The resilient sleeve 26 is described more fully in U.S. Pat. No. 4,469,467 which description is incorporated herein by reference.

The upper and lower sealing sections 30 and 32 are held against the inner surface of the manhole 10 by a pair of stainless steel fastening bands 34 and 36. As will be described, after the resilient sleeve 26 is properly located within the manhole 10, the upper fastening band 34 is expanded within the sleeve to force the outer periphery of the upper sealing section 30 against the inner surface of the manhole casting 18. The resiliency of the sleeve 26 allows the upper sealing section 30 to expand against the manhole casting 18 and form an annular barrier which prevents water flow between the upper sealing section and the manhole casting. A similar expansion of the lower fastening band 36 secures the lower sealing section 32 against the inner surface of the manhole cone 12. Once the upper and lower sealing sections 30 and 32 have been secured in this manner, any water that penetrates between the manhole casting 18, adjusting rings 16 and the manhole cone 12 will be captured by the chimney seal 24 and prevented from entering the interior cavity of the manhole 10.

Figure 2:
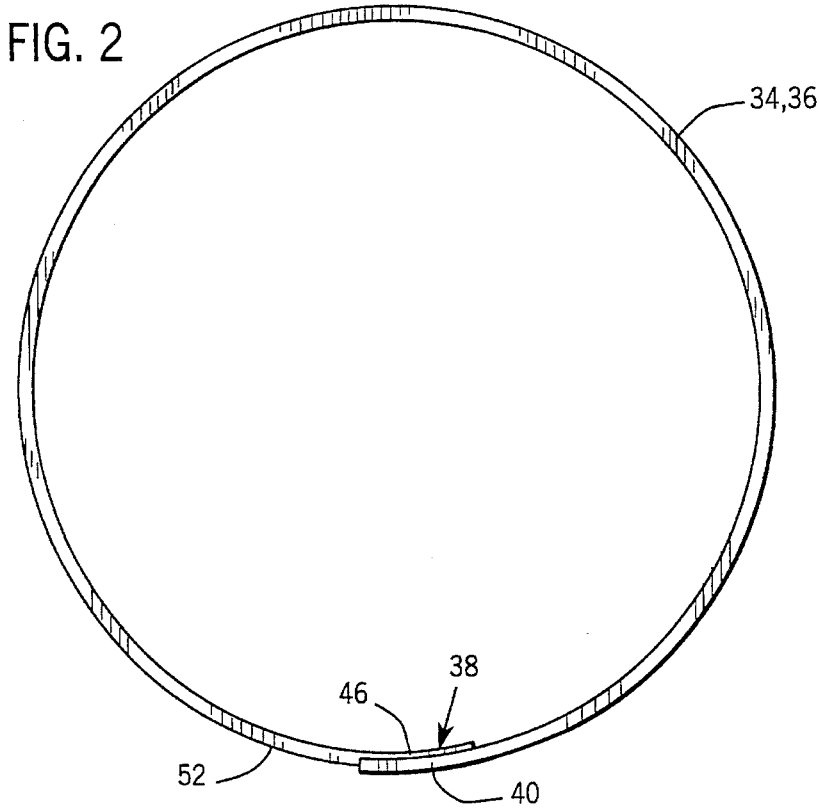
FIG. 2 is a top view of the fastening band showing the narrow end of the band nested into the other end of the band to provide a continuous retaining band after installation.
Figure 3A:
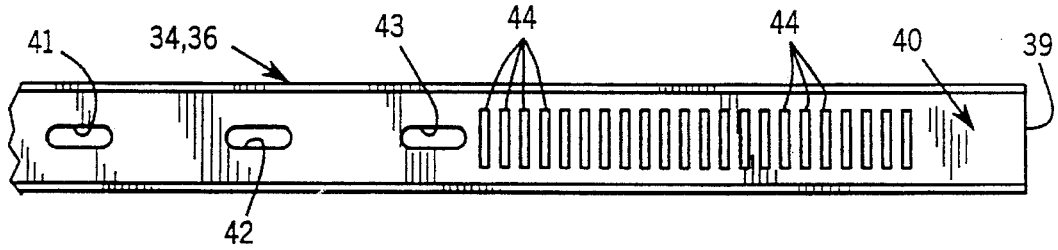
FIGS. 3A and 3B show opposite ends of the fastening band.

FIG. 2 illustrates one of the novel fastening bands 34, 36 prior to installation. Each fastening band 34 and 36 is preferably formed by a U-shaped cross section stainless steel strip which is rolled into a circle. The ends of the strip overlap at section 38 with one end being slightly reduced in size to fit within the U cross-section of the other end. As shown in FIG. 3A, a first end portion 40 has a plurality of parallel transverse slots 44 centrally located along the longitudinal dimension of the fastening band. The slots have widths that are larger than the thickness of the stainless steel and are spaced on one quarter inch centers, for example. On the remote side of the slots 44 from end surface 39 are located three oval apertures 41, 42 and 43 extending longitudinally along the center of the fastening band 34, 36.

Figure 3B:
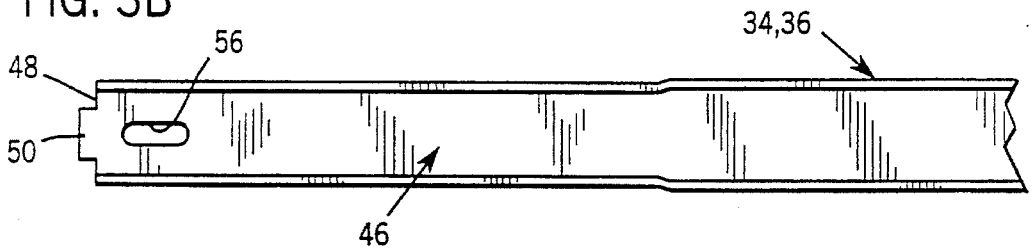
Figure 4:
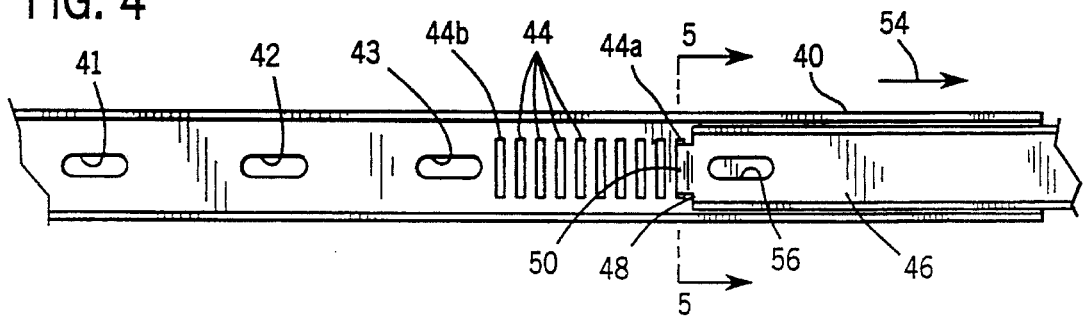
FIG. 4 shows the overlapping ends on the fastening band secured in place to firmly attach the seal within the manhole chimney.
Figure 5:
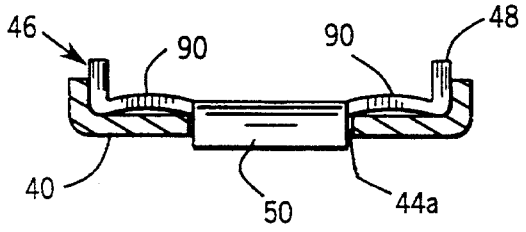
FIG. 5 is a cross section view along line 5—5 in FIG. 4.
Figure 6:
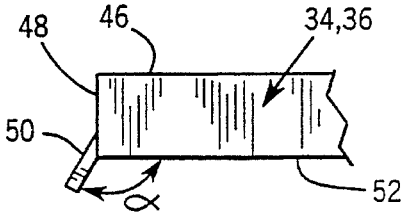
FIG. 6 is a side view of the end of the fastening band shown in FIG. 3B.

With reference to FIG. 3B, the second end portion 46 of each fastening band 34, 36 has a reduced width so that it is able to fit within the U cross-section of the first end portion 40 as illustrated in FIGS. 4 and 5. An oval aperture 56 is located adjacent this end 48 of the fastening band. A tab 50 projects from the end 48 of the narrower second end portion at an angle $\alpha$ of approximately 120 degrees from the outside circumferential surface 52 of the fastening band as shown in FIG. 6. Although an angle of 120 degrees is used in the preferred embodiment of the fastening band, the angle may be in the range from approximately 90 degrees to 180 degrees. The angle of tab 50 with respect to the outside circumferential surface 52 of the band permits the second end portion 46 to slide within the first end portion 40 in direction indicated by arrow 54 in FIG. 4. This sliding action expands the diameter of the fastening band 34, 36 and compresses the respective upper or lower sealing section 30 or 32 against the interior surface of the manhole 10. When the fastening band 34, 36 has expanded to the desired size, the tab 50 engages one of the slots 44*a* securing the end portions to form a continuous fastening band and maintain the desired size. In this secured state, the angle of tab 50 with respect to the outside circumferential surface 52 of the fastening band prevents the tab from inadvertently popping out of slot 44*a*.

To use the chimney seal 24, the manhole chimney 14 is assembled and the manhole casting 18 is placed on top of the assembled chimney with the manhole cover 20 removed. The resilient sleeve 24 then is folded and inserted through the manhole cover opening into the chimney cavity. The installer then unfolds and locates the resilient sleeve so that the upper and lower sealing sections 30 and 32 are properly positioned with respect to the chimney 14 and the manhole casting 18. While holding the resilient sleeve 26 in place, the upper and lower fastening bands 34 and 36 are placed within the two sealing sections 30 and 32. The fastening bands 34 and 36 have a hoop-like shape as shown in FIG. 2 and the installer slides the two end portions 40 and 46 together to reduce the diameter of the band so that it will fit into the ends of the resilient sleeve 26. The upper and lower sealing sections 30 and 32 have annular notches in their inner surface for receiving a fastening band.

Figure 7:
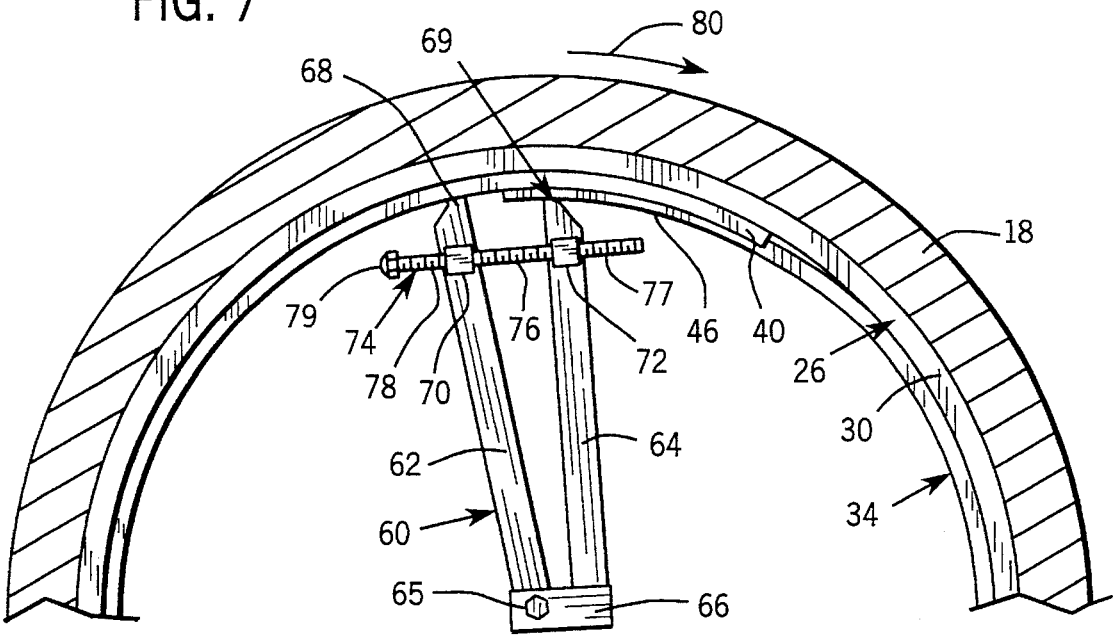
FIG. 7 illustrates the use of a tool to expand the fastening band within the manhole chimney seal.

Once each of the fastening bands 34, 36 has been placed within the notch of the appropriate sealing section 30 or 32, an expansion tool 60 is used to enlarge the fastening band to compress the sealing section against the inner surface of the manhole 10, as shown in FIG. 7, with respect to the upper sealing section 30 and upper fastening band 34. The expansion tool comprises two legs 62 and 64 which can pivot with respect to one another. Specifically, the second leg 64 has a bracket 66 welded to one end. The first leg 62 is pivotally connected to the bracket 66 by bolt 65. The remote ends 68 and 69 of legs 62 and 64, respectively, taper in size so as to fit within the oval apertures 41–43 and 56 in the fastening band 34. The remote ends 68 and 69 have outward facing hooks (not shown) within which the fastening band fits when the ends are placed within the oval apertures 41–43 and 56. In order to expand the fastening band 34, the first leg 62 has its remote end 68 placed within one of the oval apertures 41–43 in the first end of the fastening band 34. Similarly, the remote end 69 of the second leg 64 is placed within the oval aperture 56 at the second end portion 46 of the fastening band.

Separate blocks 70 and 72 are pivotally mounted adjacent the remote end of each leg 62 and 64, respectively, of the expansion tool 60. Each block 70 and 72 has a threaded aperture extending therethrough which receives a threaded rod 74. The rod 74 is divided into two longitudinal sections 77 and 78 on either side of a central unthreaded section 76. The threads on each section of the rod 74 are cut in opposite directions (i.e. left-hand and right-hand threads) and the threads in the apertures of blocks 70 and 72 are cut in the corresponding direction. When the rod is rotated, the different directions of the threads on each longitudinal half 77 and 78 cause the legs 62 and 64 of the expansion tool 60 to expand or contract depending upon the direction of that rotation. Once the rod 74 has been threaded into blocks 70 and 72, a cap nut 79 is tightly secured to one end of the rod 74 so that a wrench can be used to rotate the rod 74 in either direction without loosening the cap nut.

The expansion tool 60 may be inserted into oval apertures 43 and 56 of the upper fastening band 34 illustrated in FIG. 7. Then a wrench, such as a conventional ratchet-type socket wrench, is applied to the cap nut 79, and the installer operates the wrench to turn the rod 74 in a direction which causes the two legs 62 and 64 of the expansion tool 60 to spread apart. As this spreading occurs, the second end portion 46 of the upper fastening band 34 slides within the U-shaped cross section of the first end portion 40 in a direction indicated by arrow 80. This sliding action increases the perimeter of the upper fastening band 34 forcing the upper sealing section 30 of the resilient sleeve 26 against the inner surface of the manhole casting 18. With reference to FIGS. 4 and 7, as the tool spreads farther apart and the sliding action of the upper fastening band 34 continues, the angled tab 50 rides over the slots 44 in the first end portion 40 of the fastening band.

This sliding action continues until the installer has expanded the upper fastening band sufficiently to securely compress the upper sealing section 30 of the resilient sleeve 26 against the manhole casting 18 to prevent water seepage therebetween. At that position, the installer allows tab 50 to engage one of the slots, such as slot **44*a*, in the first end portion 40 of the fastening band. Next, the installer reverses the direction of rotation of the rod 74 to retract the two legs 64 and 66 closer together which causes the tab 50 to slide further into the adjacent slot 44*a*. Further retraction of the expansion tool 60 allows the remote ends 68 and 69 to be removed from the oval apertures 43 and 56 in the fastening band. Once the tool is removed, the fastening band remains secured against the resilient sleeve 26 due to engagement of the tab 50 with the slot 44*a*. A similar operation is used to fasten the lower fastening band 36 within the lower sealing section 32 of the chimney seal 24**.

In some manholes, either the casting 18 or the chimney 12 has a larger internal diameter than the other component. For such manholes, a sleeve 24 with a diameter corresponding to the smaller component is selected. However, a larger than usual fastening band 34, 36 often is needed to expand the sleeve against the larger one of the casting 18 and chimney 12. The large fastening band has to be formed into a smaller than normal loop in order to fit within the smaller sleeve 24. Thus, the end portion 46 of the fastening band may extend over oval apertures 42 and 43 in the other end portion 40 of the fastening band 34, 36, see generally FIG. 4.

In this case, the installer places the remote ends 68 and 69 of the expansion tool 60 into oval slots 41 and 56 in opposite end portions 40 and 46 of the fastening band 34, 36. A wrench is used to spread apart the expansion tool legs 62 and 64 thereby expanding the fastening band. The expansion continues until the tab 50 on end portion 46 engages the first slot **44*b* in the other end portion 40 of the fastening band. The legs 64 and 66 of expansion tool 60 then are brought together so that the tool can be removed from oval apertures 41 and 56. The engagement of tab 50 into slot 44*b* maintains the fastening band 34, 36 in an intermediate expanded state. Then the expansion tool 60 is reinserted into oval apertures 43 and 56 and operated as previously described to expand the fastening band until tab 50 engages slot 44*a* as shown in FIG. 4**.

The engagement of the tab 50 with the slot **44*a* holds the fastening band in an expanded position to compress the sealing section 30 or 32 of the chimney seal 24 against the appropriate part of the inner surface of the manhole 10. The use of the tab and slots to secure the fastening band in this expanded condition does so without any fastening elements protruding into the passageway of the manhole chimney 14**. Thus, this present fastening mechanism does not obstruct the chimney passageway which could cause injury to a person entering the manhole.

Figure 8:
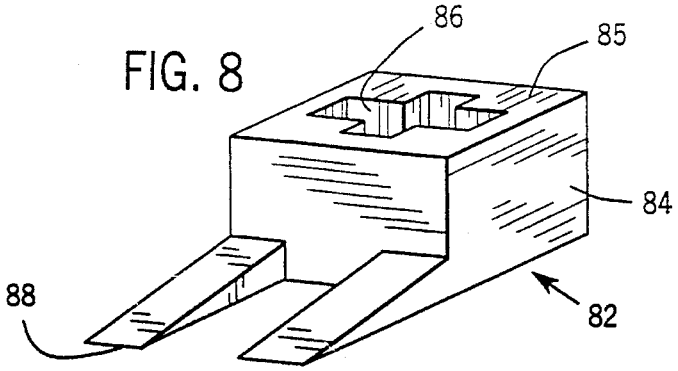
FIG. 8 illustrates an attachment for the tool in FIG. 6 that is used to detach the fastening band.

There may come a time at which the chimney seal 24 has to be removed from the manhole 10, such as for repair of the chimney 14 or to raise the manhole casting 18 to accommodate resurfacing of a roadway. For this purpose, a removal fixture 82 shown in FIG. 8 is attached to the remote end 69 of the expansion tool leg 64. The removal fixture 82 has a generally cubic body 84 with a top surface 85 that has a cross-shaped aperture 86 therein. The cross-shaped aperture 86 is shaped and sized to receive the remote end 69 of the expansion tool leg 64. A pair of wedge-shaped claws 88 extend from one side of the body 82 and are spaced apart by a distance that is slightly greater than the width of the tab 50 on the second end portion 46 of a fastening band 34 or 36.

Figure 9:
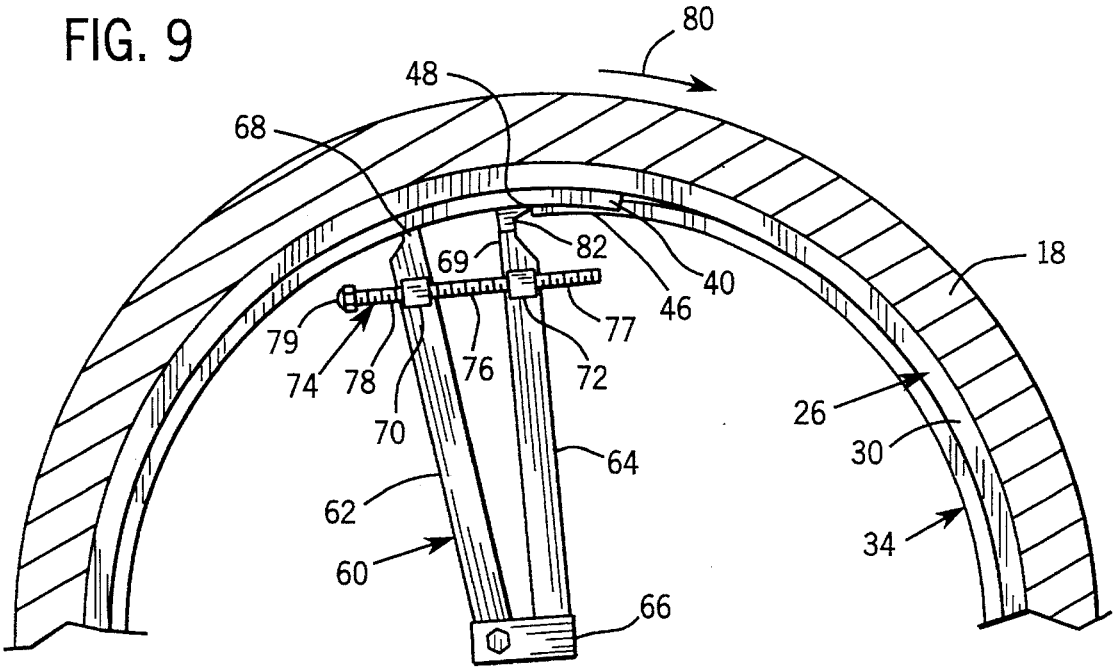
FIG. 9 shows the use of the tool and attachment to remove the fastening band.

With reference to FIG. 9, the removal claw 82 is placed on the remote end 69 of the expansion tool leg 64 with the claws 88 facing outward toward the exposed end 48 of expansion band 34. The pointed tips of the claws are placed against end 48 on opposite sides of the tab 50 so that the tab is between the claws. The remote end 68 of the other expansion tool leg 62 is placed into one of the oval apertures 41–43 in the first end portion 40 of the upper fastening band 34. Once the expansion tool 60 and the attached removal claw 82 have been applied to the fastening band in this manner, a wrench is used to rotate the rod 74 and spread apart the two legs 62 and 64 of the expansion tool 60. This spreading action causes the claws 88 of the removal claw 82 to wedge in between the first and second end portions 40 and 46 of the upper fastening band. To aid in the insertion of the claws 88, end 48 of the second end portion has dimples 90 on both sides of the tab 50 as shown in FIG. 5. As the spreading of the expansion tool 60 continues, the claws 88 enter farther between the two fastening band end portions 40 and 46 and the wedge shape of claws 88 pulls the tab 50 out of the slot 44*a* in the first end portion 40. Once the tab 50 is fully out of the slot 44*a*, the end 48 of the second end portion 46 rests against the body 84 of the removal fixture 82.

At this point, the user reverses the direction of rotation of the rod 74 to retract the legs 62 and 64 of the expansion tool 60 which causes the end portions 40 and 46 to slide together reducing the inner diameter of the upper fastening band 34. Because the end 48 of the second end portion 46 is raised away from the first end portion 40, tab 50 is unable to drop into any of the slots 44. This sliding together continues until the tab 50 has slid past all of the slots 44, at that time the upper fastening band 34 can be grasped by the user and pulled out of the resilient sleeve 26. A similar procedure is employed to remove the lower fastening band 36. Once the fastening bands 34 and 36 have been removed, the resilient sleeve 26 can be folded inward and pulled out of the manhole 10 through the opening in the casting 18 for the manhole cover 20. After repair to the manhole 10, the resilient sleeve 26 and the upper and lower fastening bands 34 and 36 can be reinstalled in the manhole 10 using the process previously described.

I claim:

1. A fastening band for forcing an expandable resilient seal against a surface of a manhole, said fastening band having a first end portion and a second end portion which overlap and which when connected together form a continuous hoop with an outer perimeter which substantially continuously engages the expandable resilient seal, the first end portion has a plurality of holes spaced longitudinally along the fastening band, and the second end portion has a tab for engaging one of the plurality of holes to connect the first end portion to the second end portion with the one of the plurality of holes being selected to adjust a perimeter of the fastening band to a desired size.

2. The fastening band as recited in claim 1 wherein the fastening band has a U-shaped cross section along substantially an entire length of the fastening band.

3. The fastening band as recited in claim 2 wherein the second end portion has a width that is narrower than a width of the first end portion so that the second end portion fits within the U-shaped cross section at the first end portion.

4. The fastening band as recited in claim 2 wherein the U-shaped cross section is formed by a base section with opposing edges from which extend a pair of side walls, and wherein the plurality of holes are formed in the base section.

5. The fastening band as recited in claim 1 wherein the first end portion has a first aperture and the second end portion has a second aperture, the first and second apertures for receiving a tool to adjust the perimeter of the fastening band.

6. The fastening band as recited in claim 5 wherein at least one of the first end portion and the second end portion has additional apertures for receiving the tool.

7. The fastening band as recited in claim 1 wherein the tab projects from an end of the second end portion.

8. The fastening band as recited in claim 1 wherein the second end portion has an outside curved surface and the tab projects from the outside curved surface at an angle which is substantially between 90 degrees and 180 degrees.

9. The fastening band as recited in claim 1 wherein the first end portion has an first element and the second end portion has a second element, wherein the first and second elements receive a tool to adjust the perimeter of the fastening band.

10. The fastening band as recited in claim 1 wherein the second end portion has a U-shaped cross section.

11. The fastening band as recited in claim 1 wherein the fastening band is formed of a single strap of metal.

12. A sealing system for chimney joints of a manhole, wherein said sealing system comprises:

a sleeve made of an resilient expandable material and having sealing sections at each end thereof for engaging an inside surface of a manhole chimney; and two fastening bands associated with the sealing sections of said sleeve, each fastening band having a first end portion and a second end portion which overlap and which when connected together form a continuous hoop with an outer perimeter which substantially continuously engages said sleeve, the first end portion has a plurality of holes spaced longitudinally along the fastening band, and the second end portion has a tab for engaging one of the plurality of holes to connect the first end portion to the second end portion with the one of the plurality of holes being selected to adjust a perimeter the fastening band to a desired size.

13. The sealing system as recited in claim 12 wherein the fastening band has a U-shaped cross section along substantially an entire length of the fastening band.

14. The sealing system as recited in claim 13 wherein the second end portion has a width that is narrower than a width of the first end portion so that the second end portion fits within the U-shaped cross section at the first end portion.

15. The sealing system as recited in claim 13 wherein the U-shaped cross section of each fastening bend is formed by a base section with opposing edges from which extend a pair of side walls, and wherein the plurality of holes are formed in the base section.

16. The sending system as recited in claim 12 wherein the second end portion has an outside curved surface and the tab projects from the outside curved surface at an angle which is substantially between 90 degrees and 180 degrees.

17. The sealing system as recited in claim 12 wherein the first end portion has a first aperture and the second end portion has a second aperture, the first and second apertures for receiving a tool to adjust the perimeter of the fastening band.

18. The sealing system as recited in claim 17 wherein one of the first end portion and the second end portion has additional apertures for receiving the tool.

19. The sealing system as recited in claim 17 further comprising a tool for adjusting the perimeter of the fastening band, wherein said tool comprises:

a first leg having a first member for engaging the first aperture;

a second leg having a second member for engaging the second aperture, and pivotally connected to the first leg; and a mechanism attached to the first leg and the second leg to produce pivotal movement therebetween.

20. The sealing system as recited in claim 19 further comprising a band removal fixture for attachment to the second leg of the tool, said band removal fixture having a body with a pair of wedge shaped claws extending therefrom for siding between the first end portion and the second end portion to extract the tab from the one of the plurality of holes.

21. The sealing system as recited in claim 12 further comprising a band removal tool having a body with a pair of wedge shaped claws extending therefrom for siding between the first end portion and the second end portion to extract the tab from the one of the plurality of holes.

22. The sealing system as recited in claim 21 wherein an end of the second end portion has dimples on opposite sides of the tab for receiving the wedge shaped claws.

23. The sealing system as recited in claim 12 wherein the first end portion of each fastening band has an first element and the second end portion of each fastening band has a second element, said first and second elements receive a tool to adjust the perimeter of the fastening band.

24. The sealing system as recited in claim 12 wherein the second end portion of each fastening band has a U-shaped cross section.

25. The sealing system as recited in claim 12 wherein the fastening band is formed of a single strap of metal.

26. A tool for removing a manhole seal fastening band which has two overlapping end portions with a tab on one end portion inserted into a hole in another end portion, wherein said tool comprises a body, and a pair of wedge shaped claws spaced apart and extending from said body for siding between the two end portions with the tab received between said claws to extract the tab from the one of the hole.

27. The tool as recited in claim 26 further comprising a pair of legs pivotally connected together with the body attached to one leg; and a mechanism connected to the pair of legs to produce pivotal movement between the pair of legs.

28. A manhole sealing method comprising:

inserting a resilient sleeve within a manhole;

placing, into the sleeve, a hoop-shaped fastening band having overlapping first and second end portions wherein an outer perimeter of the fastening band substantially continuously engages said sleeve, wherein the second end portion has a U-shaped cross-section;

sliding the first and second end portions which respect to each other to increase a perimeter of the fastening band; and engaging a tab on the second end portion into a first hole in the first end portion to form a continuous loop-shaped fastening band which compresses the resilient sleeve against an interior surface of the manhole.

29. The manhole sealing method recited in claim 28 wherein the sliding step comprises placing one leg of an expansion tool into an aperture in the first end portion; placing a second leg of the expansion tool into an aperture in the second end portion; and spreading the legs apart to produce sliding between the first and second end portions.

30. The manhole sealing method as recited in claim 28 wherein the sliding step comprises:

placing a first leg of an expansion tool into a first aperture in the first end portion;

placing a second leg of the expansion tool into a second aperture in the second end portion;

spreading the first and second legs apart to produce sliding between the first and second end portions;

inserting the tab on the second end portion into a second hole in the first end portion to hold the fastening band in an intermediate position;

removing the first leg from the first aperture;

placing a first leg of the expansion tool into a third aperture in the first end portion; and again spreading the first and second legs apart to produce further sliding between the first and second end portions until the tab is adjacent to the first hole.

* * * * *